US006674069B1

(12) United States Patent
Martin et al.

(10) Patent No.: US 6,674,069 B1
(45) Date of Patent: Jan. 6, 2004

(54) IN-LINE REFLECTING TIME-OF-FLIGHT MASS SPECTROMETER FOR MOLECULAR STRUCTURAL ANALYSIS USING COLLISION INDUCED DISSOCIATION

(75) Inventors: Charles D. Martin, Arlington, MA (US); Gary L. Samuelson, Amesbury, MA (US); Edward E. Owen, Nashua, NH (US); Jeffrey W. Finch, Mendon, MA (US)

(73) Assignee: Jeol USA, Inc., Peabody, MA (US)

( * ) Notice: Subject to any disclaimer, the term of this patent is extended or adjusted under 35 U.S.C. 154(b) by 0 days.

(21) Appl. No.: 09/868,345

(22) PCT Filed: Dec. 17, 1999

(86) PCT No.: PCT/US99/30269

§ 371 (c)(1),
(2), (4) Date: Sep. 12, 2001

(87) PCT Pub. No.: WO00/36633

PCT Pub. Date: Jun. 22, 2000

Related U.S. Application Data

(60) Provisional application No. 60/112,615, filed on Dec. 17, 1998.

(51) Int. Cl.[7] ..... H01J 49/40
(52) U.S. Cl. ..... 250/287
(58) Field of Search ..... 250/287, 242, 250/396 R

(56) References Cited

U.S. PATENT DOCUMENTS

| | | | | |
|---|---|---|---|---|
| 2,839,687 A | | 6/1958 | Wiley | 250/41.9 |
| 4,072,862 A | | 2/1978 | Mamyrin et al. | 250/286 |
| 5,077,472 A | | 12/1991 | Davis | 250/287 |
| 5,180,914 A | | 1/1993 | Davis et al. | 250/287 |
| 5,233,189 A | | 8/1993 | Wollnik | 250/287 |
| 5,464,985 A | | 11/1995 | Cornish et al. | 250/396 R |
| 6,020,586 A | | 2/2000 | Dresch et al. | 250/287 |
| 6,300,626 B1 | * | 10/2001 | Brock et al. | 250/287 |

* cited by examiner

*Primary Examiner*—Kiet T. Nguyen
(74) *Attorney, Agent, or Firm*—Webb Ziesenheim Logsdon Orkin & Hanson, P.C.

(57) ABSTRACT

A tandem mass spectrometer apparatus includes an ion source (29); a first mass spectrometer MS-1 having a magnetic sector (24) and an electric sector (21); and a second mass spectrometer MS-2 having a CID cell (13), an offset parabolic ion mirror (17) and an ion detector (18).

5 Claims, 8 Drawing Sheets

SHAPED FIELD BUNCHER

IN-LINE REFLECTING TIME-OF-FLIGHT MASS SPECTROMETER FOR MOLECULAR STRUCTURAL ANALYSIS USING COLLISION INDUCED DISSOCIATION

This application claims the benefit of Provisional appl. No. 60/112,615, filed Dec. 17, 1998.

BACKGROUND OF THE INVENTION

Mass spectrometers are commonly used for the determination of the mass of analyte molecules. In these instruments, ionized molecules are typically either created or introduced into a high vacuum chamber and accelerated to a known kenetic energy. Magnetic fields and electric fields are then used in various methods and fashions for mass selection, mass filtering, and thereby mass determination of the ionized molecules. Among the various types of mass spectrometers commercially available today, there are included magnetic sector, time-of-flight (TOF), ion trap, quadrupole, and ion cyclotron resonance instruments. There are also available instruments that are combinations of the various techniques of mass analysis.

In a typical sector mass spectrometer, a magnetic field (magnetic sector) mass analyzer is scanned over a mass range of interest causing an ion beam output spectrum of mass versus magnetic field intensity. There is commonly also an electrostatic analyzer (ESA) either before or after the magnetic sector, so as to select only ions of a narrow energy distribution, thereby improving resolution, a measure of the selectivity of the mass analysis. Scanning of the magnetic fields and electric fields is a relatively slow process resulting in low efficiency as the ionization is typically, although not always, a continuous process.

By contrast, in a typical time-of-flight mass spectrometer, the entire mass range is analyzed in a single experiment, limited in time only by the mass dependant flight time of the ions in the vacuum chamber, a period measured in microseconds. Time-of-flight instruments have a significant duty cycle advantage over scanning instruments which require a much longer time period to scan the selected mass range.

In mass spectrometry, it is desirable not only to investigate the mass of the intact analyte molecules, but to also be able to dissociate selected analyte molecules (precursor ions) and investigate the mass of the dissociated product ions (fragment ions), and thereby investigate the structure of the precursor analyte molecules. In a typical mass spectrometer designed for MS/MS experiments, there is an MS1 mass analyzer wherein the analyte precursor molecule is mass analyzed and selected, a dissociation region wherein the mass selected precursor ion is collided with a gas, photons, or a surface, thereby causing dissociation of the precursor ions, and an MS2 mass analyzer wherein the resulting product ions are mass analyzed. This is commonly referred to as MS/MS spectrometry or tandem mass spectrometry. Tandem mass spectrometry plays an essential role in the structural analysis of a wide variety of compounds including biomolecules, such as peptides, proteins, and oligonucleotides.

In Collision Induced Dissociation (CID), the mass selected precursor ions from MS1 are passed through a region of relatively high pressure, causing the precursor ions to collide with a target gas molecule. The energy imparted to the precursor ion in such a collision will frequently lead to dissociation of the precursor ion. The efficiency of the CID process is determined in great part on the choice of target gas and the density of the target gas in the collision cell and is proportional to the kenetic energy (KE) of the precursor ion.

The most common MS/MS instruments have until recently been high performance tandem sector instruments. These instruments tend to be large and expensive, and, due to the scanning nature of sector instruments, the product ion collection efficiency has been very low.

An alternative solution is the use of a TOF analyzer as a second stage (MS2) for a sector instrument. Clayton and Bateman (Rapid Communications in Mass Spectrometry (RCM) 6 (1992) 719) proposed such an instrument that employed orthogonal extraction into a TOF analyzer. However, to perform high energy CID experiments, only an "in-line" arrangement can be considered. An in-line arrangement also provides higher CID ion collection efficiency.

An in-line tandem TOF system was proposed by Davis and Evans in U.S. Pat. No. 5,180,914. In their system, a quadrupole field, pulsed, ion storage device was used to decelerate and mass analyze ions in a TOF MS1. The ions then passed through a dissociation region of a few millimeters where a timed laser pulse was applied (Photo Dissociation Spectrometry), after which the fragment ions (as well as the remaining parent ions) entered a TOF MS2 where the product ions were mass analyzed using a quadrupole field reflectron.

A reflectron (or ion mirror) as disclosed, for example, in Mamyrin et al. U.S. Pat. No. 4,072,862, is an electric field device that reflects ions backwards so as to increase the ion flight times and thereby increase the temporal resolution of the spectral results. Ion mirrors have the ability to correct the kinetic energy (KE) differences of ions of the same mass, thereby improving the quality of the mass spectrum. A true parabolic field reflectron is known to be energy independent for ions of the same mass over a very large mass range (Davis et al. U.S. Pat. No. 5,077,472), and has a single spatial focus point for ions irregardless of mass. This type of reflectron can correct for very large KE differences in the temporal focusing of ions. A disadvantage in using a parabolic field reflectron is that the spatial focal point of such a reflectron is located exactly at the entrance to the reflectron. In this invention, an offset parabolic field reflectron is introduced. Use of an offset parabolic field moves the reflectron spatial focal point beyond the entrance of the reflectron, thereby providing for field free regions to exist between the reflectron and its focal point.

Two groups have proposed in-line sector and TOF combinations: Derrick et al. (Int. J. Mass Spec. Ion Proc.) constructed a system based on some of the principles of the tandem TOF design of the Davis and Evans patent. In their implementation, a linear field two-plate ion buncher and a quadratic field planar symmetry reflectron were indicated. A parabolic curve of the shape $V=Kd^2$ is independent of energy variations, however, there is no field free drift region allowed prior to the focus. In a parabolic field reflectron, the spatial focal point of the reflectron will be located exactly at the entrance to the reflectron.

Cotter, Cornish, and Musselman (RCM 8 (1994) 339) proposed the use of a curved field reflectron in a tandem sector/TOF instrument, however, a method of selection and focusing of the analyte precursor ions was not considered. In a curved field reflectron, field free regions may be defined in front of the reflectron. In TOF systems, these field free regions are commonly referred to as L1 and L2. In a curved field reflectron, ion flight times for a given mass are not completely energy independent. In an offset parabolic field reflectron, above a low energy threshold determined by the offset value, ion flight times of a given mass are completely energy independent, an important feature of this invention.

In this invention, an offset parabolic field reflectron is used to achieve very high mass accuracy and resolution over the entire MS2 product ion mass range, above a low energy threshold determined by the offset value.

It will be recognized by those skilled in the art that other types of mass spectrometers, e.g., MALDI-TOF (Matrix Assisted Laser Desorption), or ESI-TOF (Electro Spray Ionization) instruments could, and have been, substituted for the sector instrument as MS1. The invention described herein has application in these other types of mass spectrometers, as well as the traditional sector instruments.

SUMMARY OF THE INVENTION

Briefly, according to this invention, there is provided a tandem mass spectrometry method with collision induced dissociation (CID) comprising the steps for: a) using a first mass spectrometer to select precursor ions of a selected mass, b) forming a packet of precursor ions, c) assigning a focusing energy to each packet of precursor ions in the ion buncher so as to bring the ions into temporal focus at some point in space, d) fragmenting the selected precursor ions near the spatial focus point to form product ions, e) passing the precursor and product ions into an offset parabolic field ion mirror (reflectron) for providing TOF dispersion among product ions of differing mass-to-charge ratios while maintaining near zero flight time dispersion (at the focal point) among product ions of the same mass-to-charge ratios but having large energy differences, and f) detecting the arrival times of the precursor and product ions. Preferably, the precursor and product ions pass through a field free region.

Preferably, the packets of precursor ions are formed by assigning a focusing energy pulse to eject ions from an ion source region in MS1 or gating a pulse of near mono-energetic precursor ions to an ion buncher.

Also, according to this invention, there is provided a tandem mass spectrometry apparatus comprising: a) a first mass spectrometer for selecting precursor ions of a pre-defined mass, b) apparatus for forming ion packets, preferably, a device for assigning a focusing energy pulse in the ion source, or an ion gate for forming a packet of precursor ions, alternatively, an ion buncher for applying a focusing pulse, c) a collision chamber for fragmenting the bunched precursor ions near the spatial focus point so as to form product ions, d) an ion mirror (reflectron) for providing TOF dispersion among product ions of differing mass-to-charge ratios while maintaining near zero flight time dispersion at the detector among product ions of the same mass-to-charge ratio and having large energy differences, and e) a detector for detecting the arrival times of, the precursor and product ions.

Preferably, an ion buncher is provided for spatially focusing a mono-energetic pulse of precursor ions. Preferably, a field free region is provided through which the precursor and product ions pass. Preferably, the bunching device is capable of precisely focusing relatively long ion beam pulses or clusters, thereby increasing the duty cycle, and therefore sensitivity, of a measured signal. This requires special means for providing velocity compensation across the ion path region. This type of buncher is referred to herein as a long buncher.

Preferably, the ion mirror is provided with a uniquely-shaped voltage distribution which permits significant flight time dispersion between product ions of differing mass-to-charge ratios while maintaining near zero flight time dispersion among fragments of the same mass-to-charge ratios having large energy differences. This energy independence is necessary due to the large energy distribution imparted by the focusing pulse to the precursor ions. The voltage distribution in the ion mirror that provides this property, and a focus point in a field free region outside of the ion mirror, is a parabolic function that is offset from the origin. The voltage can be described by the following equation: $V=V_0+K(d-d_0)^2$.

Ions generated in an ESI-TOF or MALDI-TOF source may be analyzed in a similar fashion without the use of a an ion buncher where the focusing voltage pulse is applied to the precursor ions in the source.

BRIEF DESCRIPTION OF THE DRAWINGS

Further features and other objects and advantages will become clear from the following detailed description made with reference to the drawings in which:

FIG. 4(*b*) is an expansion of the offset region of the electric field potential diagram of the offset parabolic field reflectron according to the present invention;

DESCRIPTION OF THE PREFERRED EMBODIMENTS

Figure 1:
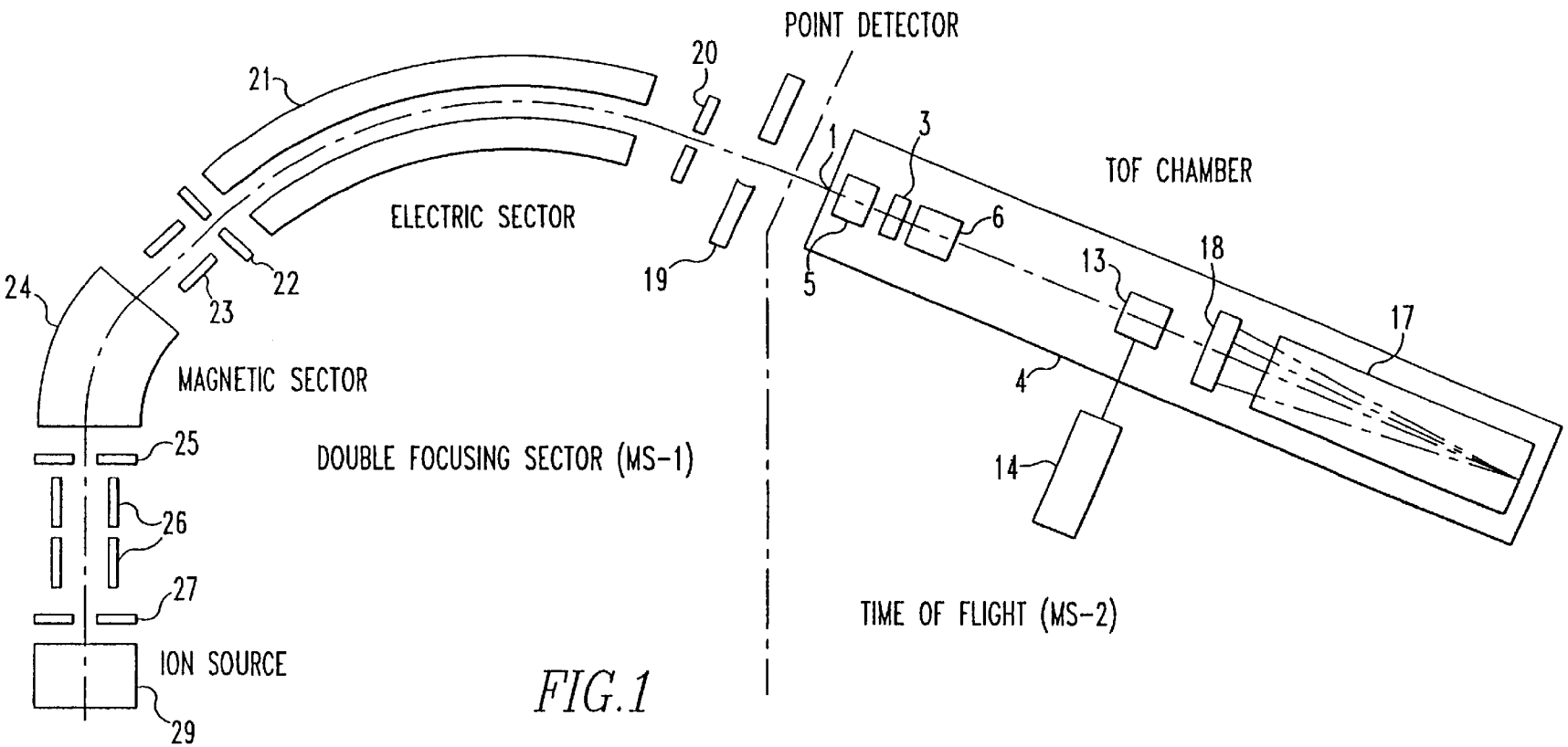
FIG. 1 is a schematic diagram of a hybrid sector-TOF mass spectrometer according to the present invention.
Figure 2:
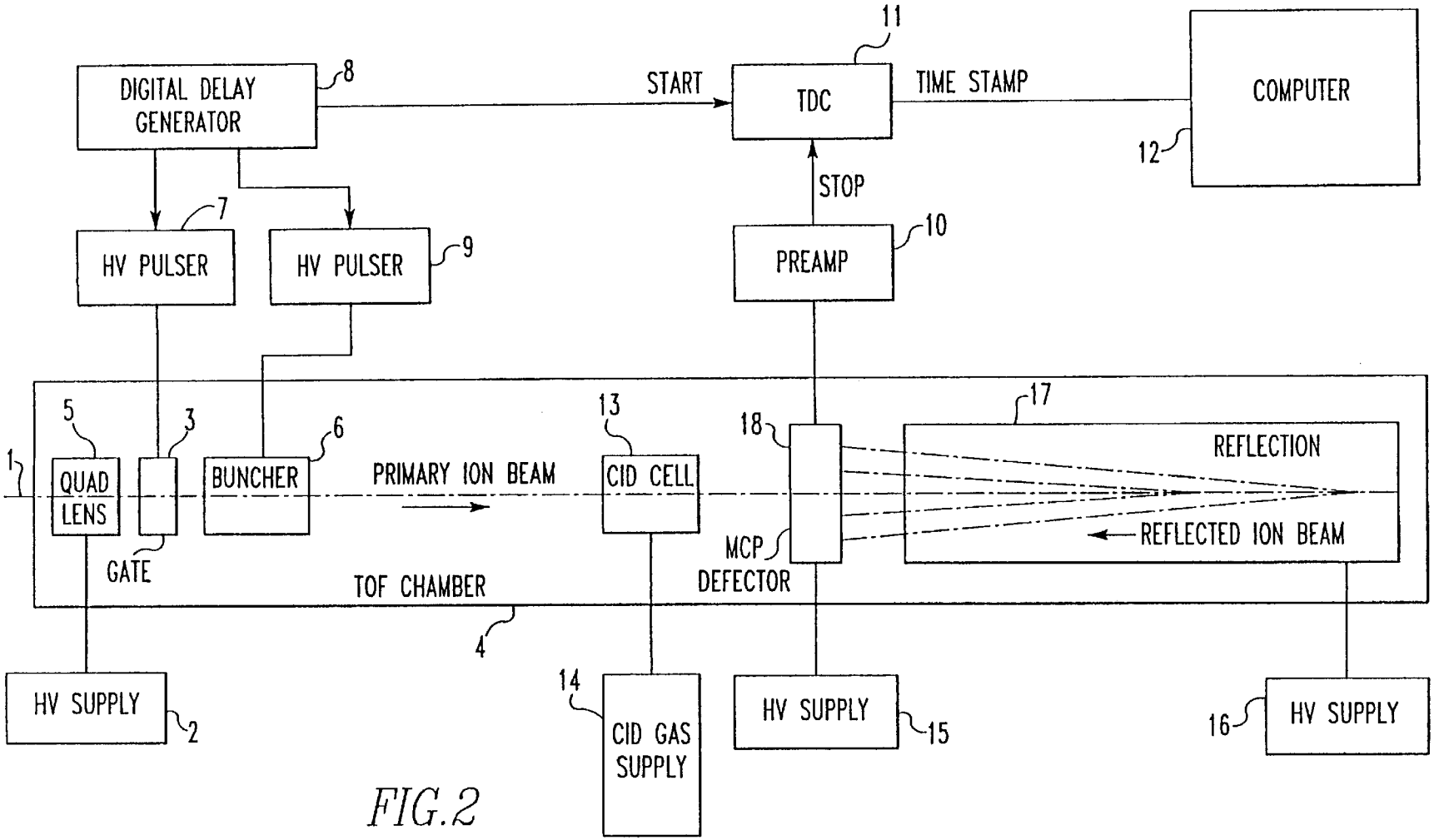
FIG. 2 is a schematic diagram for showing the TOF portion of the instrument according to the present invention.

The schematic diagrams of the in-line sector/TOF instrument are shown in FIGS. 1 and 2. FIG. 1 illustrates a hybrid sector-TOF mass spectrometer. The ion source 29 passes ions to quadrupole lens 26 with inlet and alpha slits 25 and 27 at each end thereof. The ions next pass through magnetic sector 24. The ions proceed on through lens 23 and slit 22 before entering the electric sector 21 and pass out through collector slit 20. The details of the sector instrument are not part of this invention.

In FIG. 2, the precursor ions, mass, and energy selected by the sector instrument enter the TOF analyzer through the exit slit 1 (see FIG. 2) of the sector instrument. Methods of ionization employed include fast atom bombardment (FAB), electrospray ionization (ESI), and electron impact (EI). In the TOF chamber, the ion beam is spatially focused (shaped) by a pair of quadrupole lenses 5.

The ion beam is gated by a bipolar ion gating device 3 into short packets. The ion gate is normally biased so that all ions are deflected, which is referred to herein as the ion gate ON mode. To begin an experiment, the ion gate voltage provided by power supply 7 (HV pulser) is rapidly pulsed off for a short period of time sufficient in duration to allow the ion buncher 6 to fill with precursor ions. The time required to fill the buncher is dependent on the velocity of the precursor ions and the length of the buncher and is, therefore, dependent on the acceleration voltage and the mass-to-charge (m/z) of the precursor ions.

Figure 3:
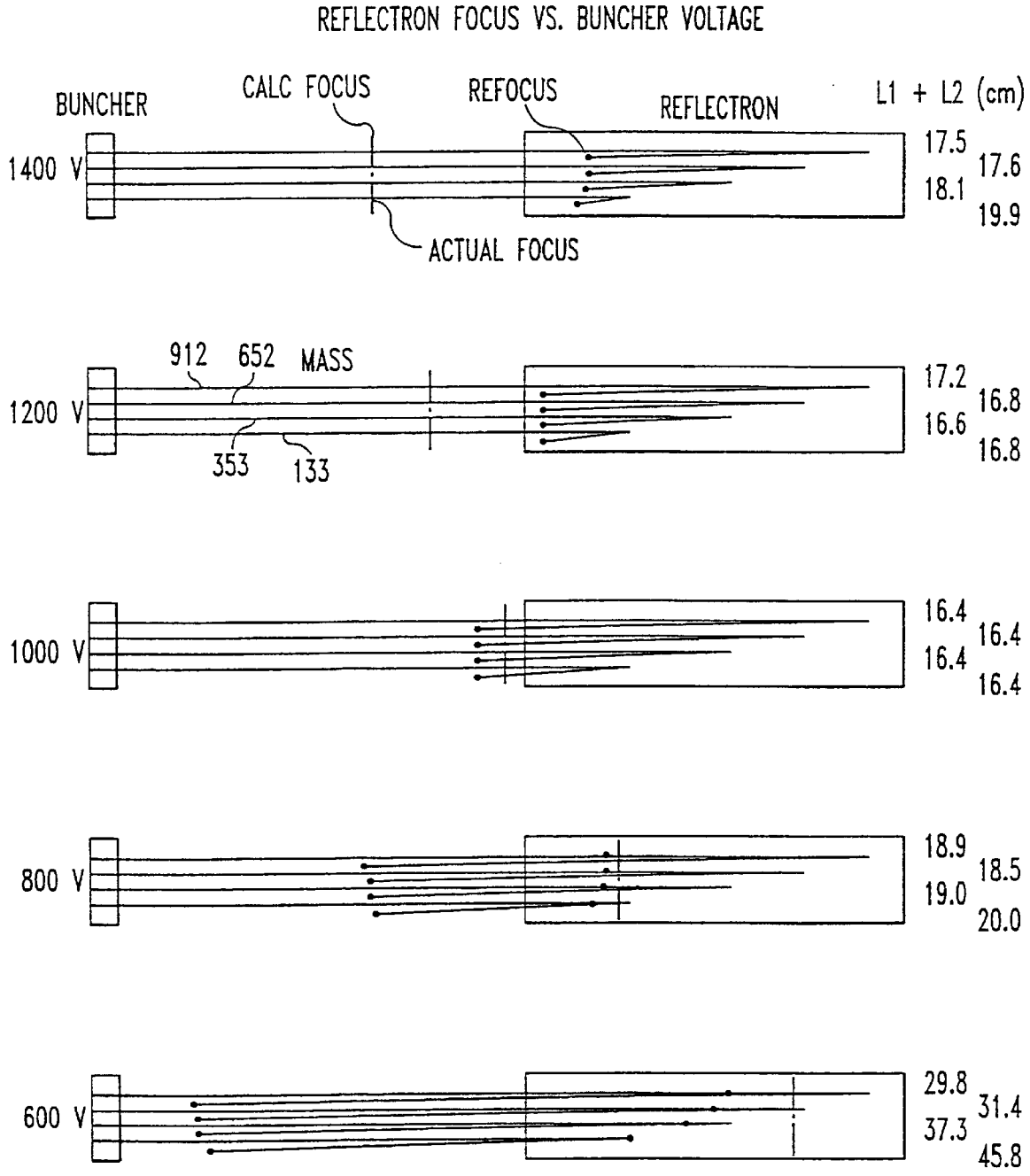
FIG. 3 is a diagram for illustrating the focus of ions of different-mass in the ion mirror and in the field free region as a function of the focusing pulse voltage.

Initial experiments with multi-electrode bunchers were less than optimum due to electric field inhomegenieties and high inter-electrode capacitance. The required high speed pulsing of the multi-electrode buncher was complicated by the presence of inter-electrode capacitance that discharged slowly through the resistor dividers required in multi-electrode geometries. Buncher lengths of 8 cm to 25 cm were constructed where each electrode was pulsed down with an isolating diode, however, the peak shapes obtained with these longer bunchers were again less than ideal. The final design of the ion buncher was accomplished by modeling a non-linear, two-plate, 4 cm length, fully shielded, shaped electrode buncher (FIG. 3) in SIMION, an ion optics modeling software program. Electrode shapes were experimentally adjusted for optimum temporal focus of the ion packet at the spatial focal point of the reflectron. Although in SIMION the theoretical temporal width of the ion packet at the spatial focal point as less the 1 ns, actual minimum peak widths at full width half max (fwhm) in the experiments with precursor ions were hardware limited to 1.5–3 ns.

Figure 5:
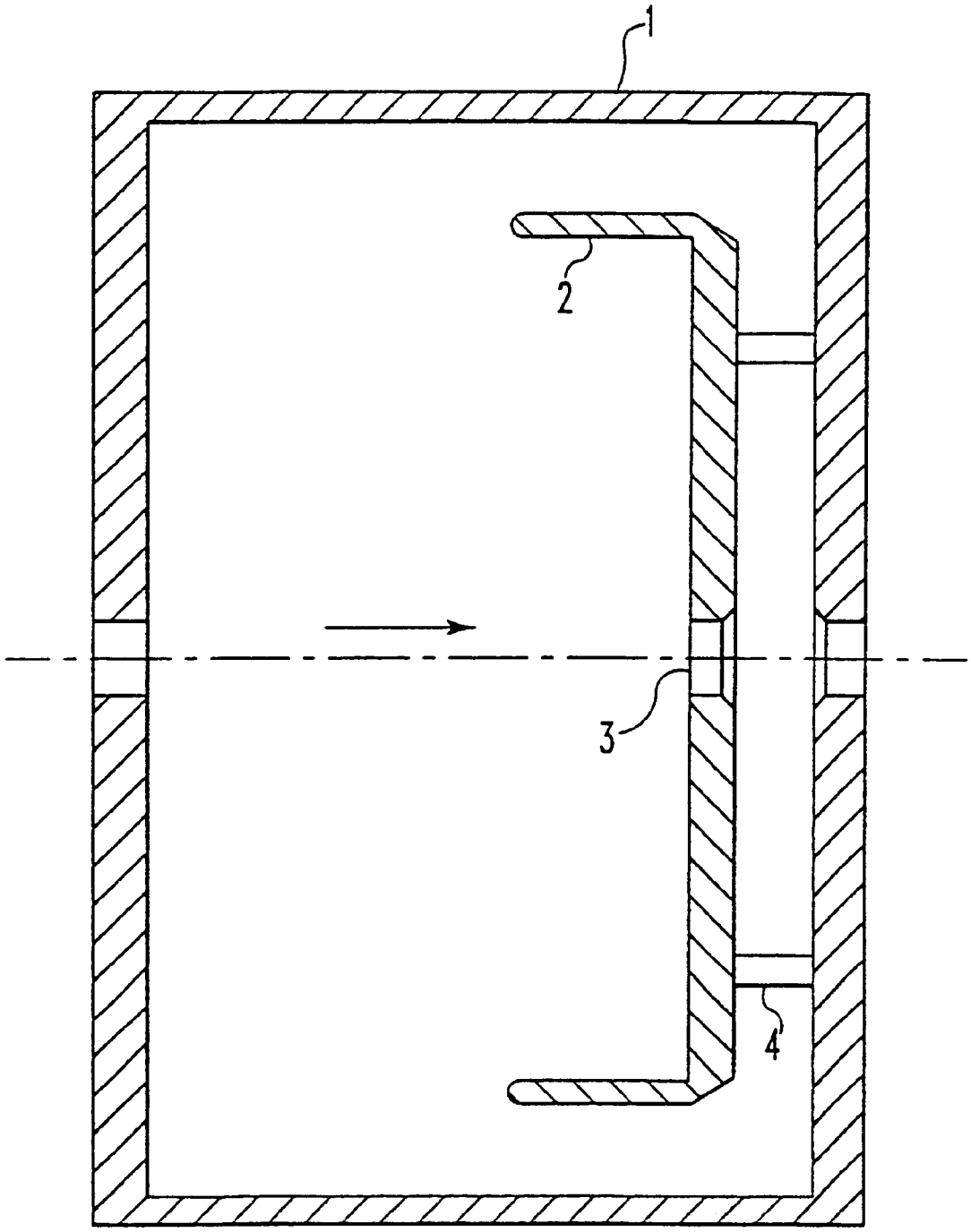
FIG. 5 is a section view of a shaped field two-plate ion buncher according to the present invention.
Figure 6:
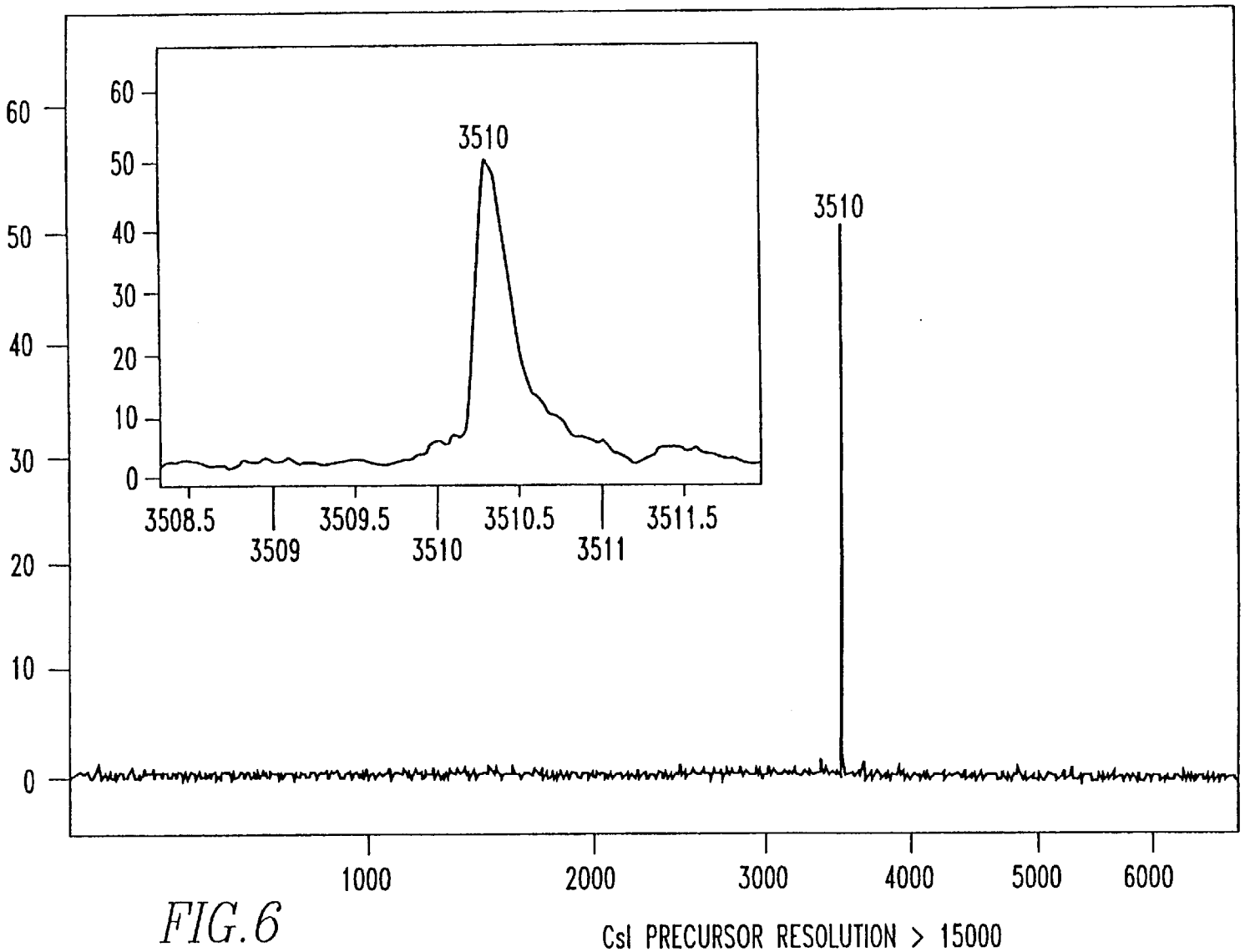
FIG. 6 shows the high resolution (15,000) spectrum of the CsI cluster at 3510 amu, a precursor ion.
Figure 7:
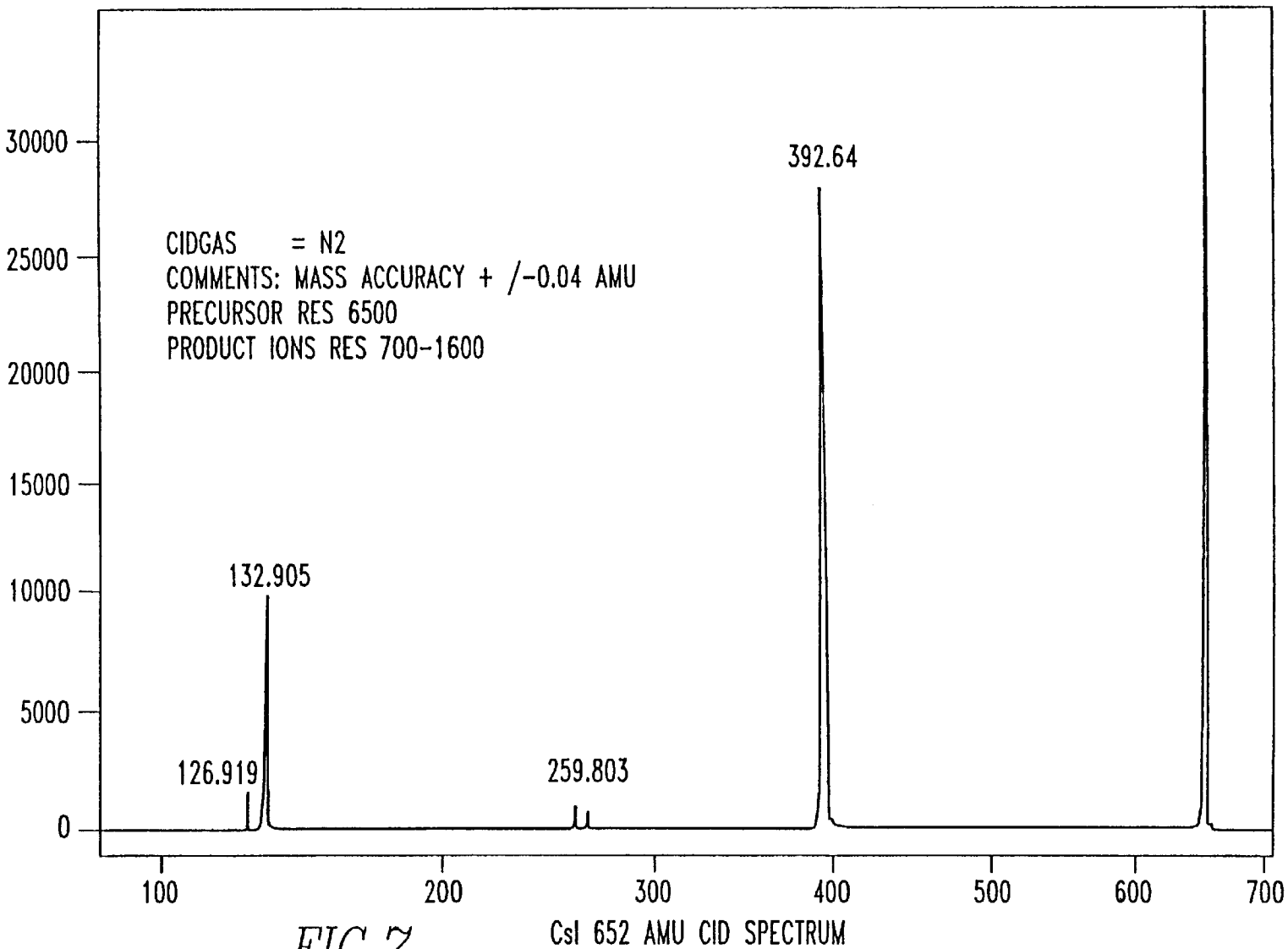
FIG. 7 shows the CID spectrum of CsI 652 amu cluster, with a mass accuracy of +/−0.04 amu and showing high resolution precursor and fragment ions acquired with the present invention.
Figure 8:
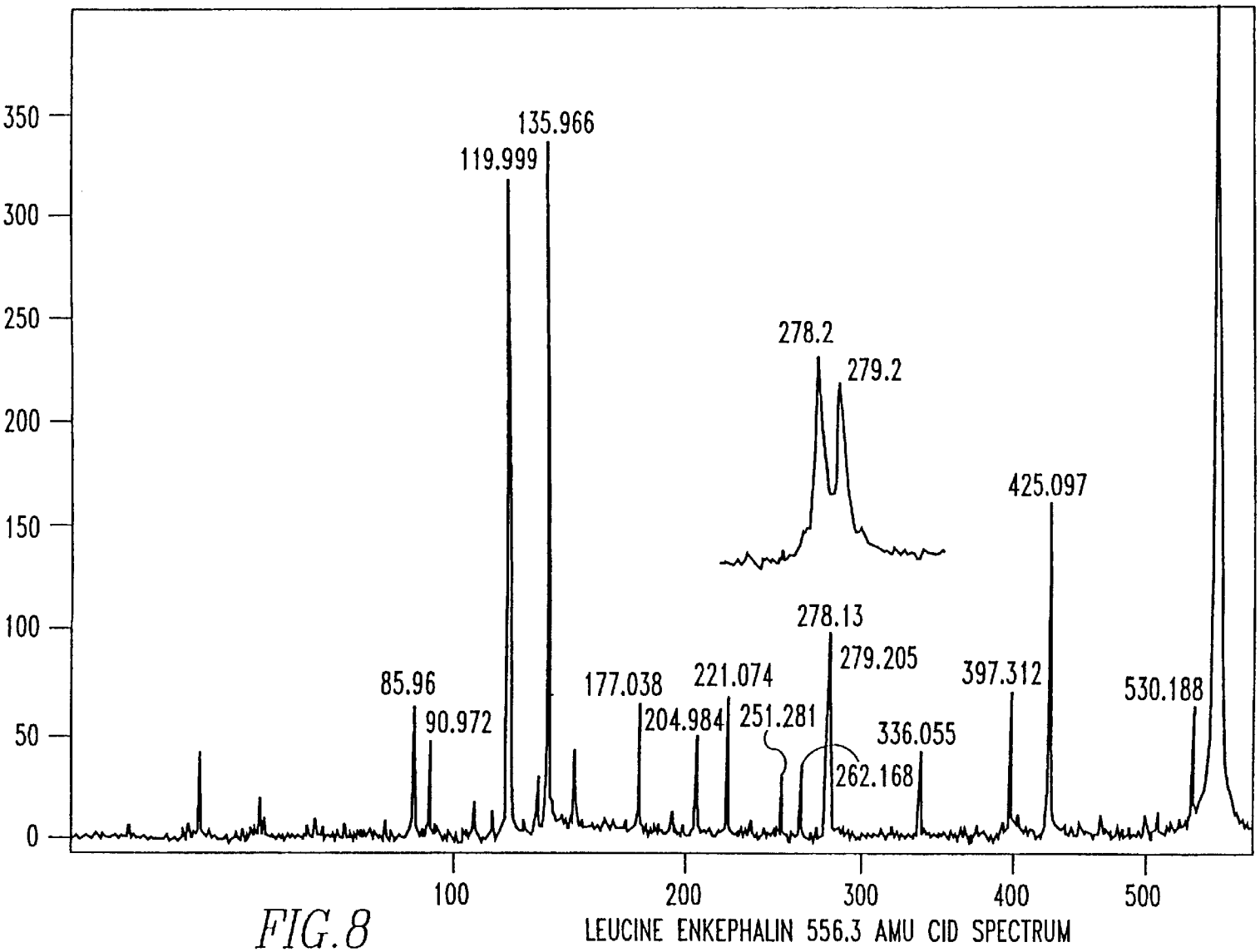
FIG. 8 shows the high energy CID spectrum of Leucine Enkephalin (556.3 amu) generated by fast atom bombardment (FAB) ionization acquired with the present invention.

For a short ion packet, good focusing can be approximated with a linear decelerating field. On the other hand, it is desirable to have as long an ion packet as possible in order to maximize the measurement duty cycle. According to the present invention, a long buncher consists of two main parts. As shown in FIG. 5, one electrode 51 is a totally enclosed, grounded can or cylinder. A cup-shaped exit electrode 52 is fixed by spacers 54 within the can. The inner electrode positioned within the can and the dimensions create the required field shape. Grounding screens are attached to the entrance and exit holes of the can thus totally isolating the inner field from the external environment. Field simulations confirm that the field shape provided by this design corresponds to the mathematically derived shape required for a linear velocity spread within the ion cluster.

The shaped field two-plate buncher modulates the ion energy in such a way that the ions arriving first lose more energy than those arriving later. The entrance electrode of the buncher is at ground potential and the exit electrode of the buncher is held at a fixed voltage during the period of time that the buncher is filling with ions, thus decelerating the ions by a value determined by the voltage potential applied to the exit electrode and the penetration depth of the ion into the buncher. When the lead ions in the ion packet reach the cup-shaped electrode 52, the exit electrode is pulsed to zero volts, thus assigning a modulation value to the ions within the buncher that is determined by each ion's position within the buncher. The ions in the lead of the ion packet will then have a velocity less than the ions in the back of the packet. The point at which the trailing ions overtake the lead ions will be the temporal focal point, and is determined by the magnitude of the modulating potential. Ideally, this focal point should be the location of the coaxial micro channel plate (MCP) detector 18 (see FIGS. 1 and 2), which is also the spatial focal point (virtual source) of the reflectron 17. Importantly, the buncher focal point is independent of the mass of the ions. Alternatively, the buncher could be loaded while both electrodes were biased at zero volts, and then a back electrode could be pulsed up so as to modulate the energies of the ions inside the buncher. The modulating energy assignments achieved in such a fashion are similar to the methods described by Wiley et al. U.S. Pat. No. 2,839,687, wherein the modulating energy assignments are imposed by an electric field pulse applied in the ion source.

The collision cell 13 is a small volume of a few millimeters in length and is located in a differentially pumped section of the vacuum chamber 4. In high energy CID experiments, the collision cell 13 is filled with a collision gas from source 14. The position of the CID cell is, in practice, not critical. Not regarding a very small kinetic energy release during dissociation, the velocity of the fragment ions will be very nearly the same as that of the parent ion. Therefore, the position of the temporal focusing point for both the parent and fragment ions is the same. It is required to locate the CID cell far enough away from the reflectron entrance so as to reduce ion dissociation in the reflectron region. Only ions that dissociate in the field free region before the reflectron will be correctly focused.

The reflectron is constructed of multiple closely spaced discs, each with center apertures to allow ion transmission. Between each disc, resistors are electrically attached for biasing the assembly with the desired voltage curve. The voltage distribution within the reflectron is a parabolic function offset from the origin. This function is obtained by defining a new origin that is offset from the initial origin of a pure parabolic function. This new function has the form: $V=V_0+K(d-d_0)^2$.

In the preferred reflector embodiment, 100 discs of 3 inch diameter were spaced 0.250 inches apart, and each disc had a center aperture of 1.5 inches. The first and last disc apertures were covered with a conductive fine mesh screen material so as to minimize electric field distortions at the entrance and exit electrodes of the reflectron. The offset voltage bias is applied between the first and second reflectron disc, with the remaining discs biased to describe a parabolic rise in voltage.

The inclusion of parameters $V_0$ and $d_0$ allow a field free region to exist in the front of the reflectron such that ions of a given mass-to-charge ratio traveling through both the field free region and the reflectron will arrive at the spatial focal point in a time substantially independent of energy. Without the offset parameters, the energy independent focal point would be at the reflectron entrance.

The offset parabolic field reflectron 17 is used to separate the product ions by mass and to compensate for the considerable energy distribution of the precursor and parent ions created by the gate-buncher combination. The offset parabolic field reflectron permits the detection of fragment ions over a large mass range without degradation of resolution because the focal length of the reflectron is not dependent on the mass of the fragment. Product ions of a very wide mass range will all have the same spatial focal point.

Alternative reflector designs were considered, however, the offset parabolic reflectron design provides the unique ability to focus the product ions without regard to the modulation energy spread introduced by the ion buncher or pulsed ion source, while at the same time providing for a field free region between the reflectron and the detector. The inclusion of a field free region in the temporal focal length of the offset parabolic reflectron allows for the space required to ideally locate the CID cell and the coaxial MCP detector.

In traditional reflectron terminology, the field free region associated with a reflectron is divided into the sum of two distances, L1 and L2. L1 is defined as the distance between the ion source and the reflectron entrance, and L2 is defined as the distance between the reflectron entrance and the plane of detection. An example ion source would be a collision cell where fragmentation takes place. The availability of regions L1 and L2 allows space to mount the collision cell and detector devices. There is a compromise associated with the selection of values $V_0$ and $d_0$. As the sum of L1 plus L2 becomes longer, not all of the ion energy range remains time independent. A threshold occurs wherein ions of an energy level below this threshold return sooner than the bulk of energy independent ions. It is desirable, therefore, to keep the L1 and L2 distances as short as possible and still allow space for the source and detection devices.

Figure 4A:
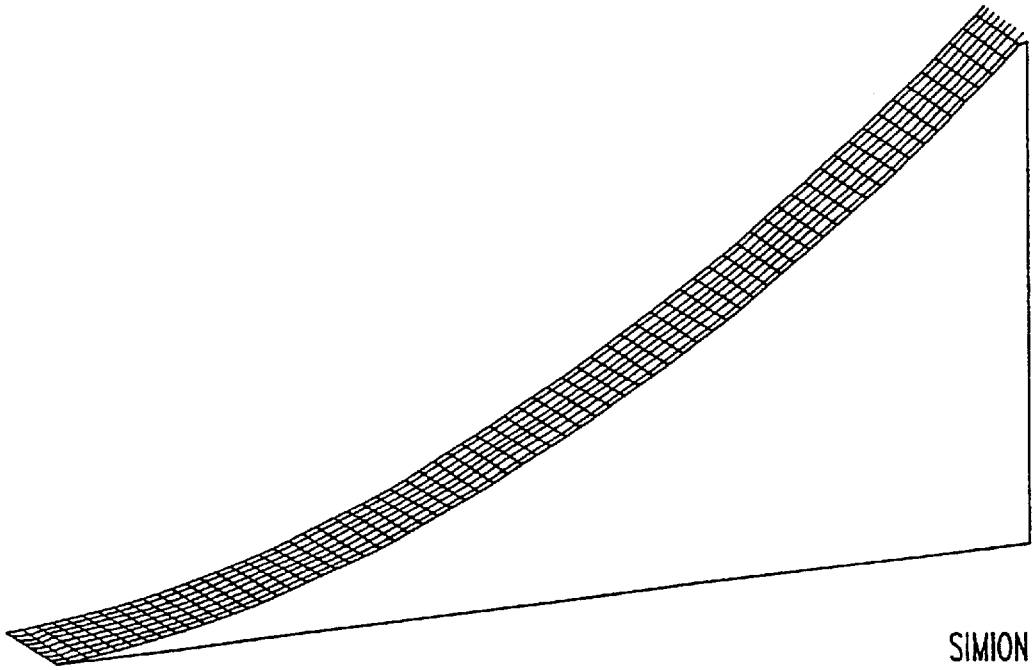
FIG. 4(*a*) is a SIMION electric field potential diagram of the offset parabolic field reflectron according to the present invention.
Figure 4B:
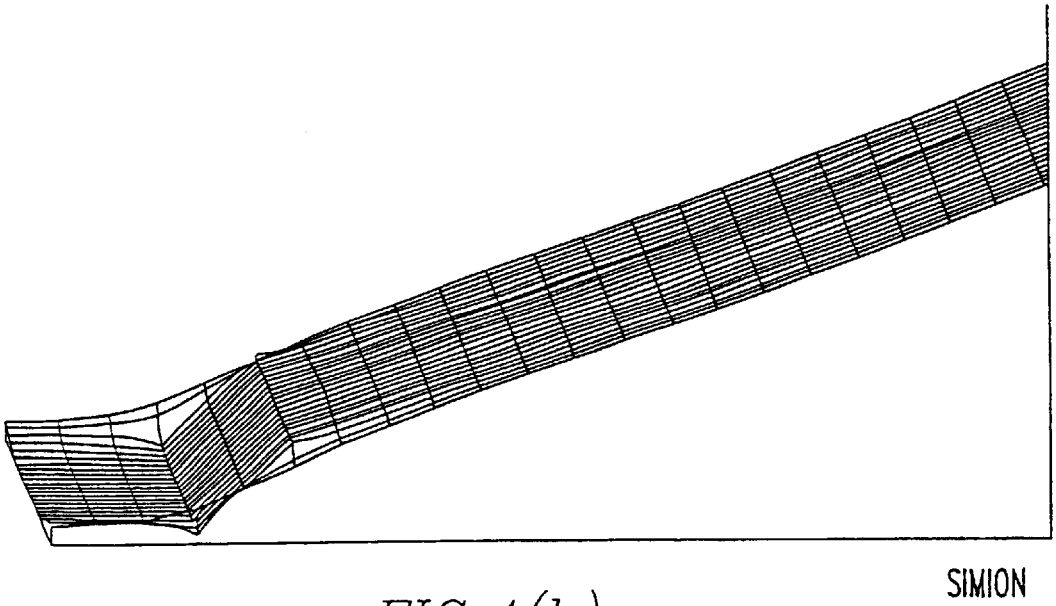

The appropriate values of $V_0$ and $d_0$ may be determined by an ion flight time simulation routine. FIGS. 4(*a*) and 4(*b*) illustrate the reflectron focus versus buncher focus for selected masses.

The ions temporally focused by the reflectron are detected by an MCP (micro channel plate) detector located at the spatial focal point of the reflectron and positioned coaxially with the primary ion beam. The coaxial MCP detector assembly has a center aperture to allow the primary ion beam to pass through it. Initial experiments using an offset conical anode MCP detector were degraded by wide peaks (3–4 ns ½ hw) and electrical ringing. In later experiments, a flat anode high speed MCP was used. This flat anode detector design is capable of producing precursor ion sub-nanosecond fwhm peaks in the instrument.

The acquisition system included a 1 GHz, multiple stop time to digital converter (TDC) 11. The minimum fwhm peak detectable by the model TDC used is 3.0 ns. The parent ion fwhm peaks from the flat anode detector were typically on the order of 1.5 ns fwhm, thus requiring the addition of some low pass filtering before the MCP detector signal is passed to the TDC input. Low noise amplifiers and low pass filters were used to provide the 100 mV threshold, 3.0 ns fwhm signal required by the TDC. Experiments using an 8 GHz Digital Storage Oscilloscope (DSO) revealed consistent precursor ion peaks of less than 2 ns fwhm, and precursor mass resolutions greater than 10,000 (fwhm) were routinely obtainable. Typically, spectra were comprised of the summed average of several thousand individual acquisitions. As the TDC operates on the principle of a start and stop signal, it has virtually zero noise, and it is therefore possible to sum many hundreds of thousands of acquisitions without the accumulation of systematic noise. The spectrum acquisition rate was limited only by the TOF of the precursor ion, and was typically 7–10 kHz. Pulse timing for the ion gate and buncher was controlled with a digital delay generator 8. The ion gate and buncher electrodes were held at a constant voltage and then rapidly pulsed down to zero volts through HV pulsers 7, 9.

A PC 12 and custom TOF analysis software were used for spectra acquisition and mass analysis. The mass axis was calibrated externally with a simple two-point calibration using a standard, which in most experiments was CsI. After instrument calibration (e.g., with CsI), the analyte sample was introduced into the ion source of the spectrometer and spectra was acquired. A one-point calibration on the analyte precursor was then used in the analyte spectra to shift the calibration constants.

An in-line sector-TOF tandem mass spectrometer has been disclosed which the sector (MS1) instrument's continuous primary ion beam (EI, FAB, ESI) is chopped by an ion gate which creates short packets of ions that are introduced into the TOF analyzer (MS2). An ion buncher is used to modulate the velocities of the ions contained within the ion packet so as to bring the ions into spatial focus at the focal point of an offset parabolic field reflectron. The reflectron is then used to separate the product ions in time according to their masses, without regard to the energy spread created in the ion buncher. The offset parabolic field reflectron permits the mass analysis of fragment ions without degradation of resolution (the focal point of the reflectron is not dependent on the mass of the fragment), while allowing field free regions to exist between the reflectron entrance and a coaxial detector. The ions, focused by the buncher-reflectron combination, are detected by a detector positioned coaxially with the primary ion beam and located at the spatial focal point of the reflectron.

Having thus described our invention in the detail and particularity required by the Patent Laws, what is desired protected by Letters Patent is set forth in the following claims.

What is claimed is:

1. A tandem mass spectrometry method with collision induced dissociation comprising the steps for:

a) using a first mass spectrometer to select precursor ions of a selected mass;

b) forming a packet of precursor ions;

c) focusing each packet of precursor ions;

d) fragmenting the packet of focused precursor ions so as to form product ions;

e) passing precursor and product ions into an offset parabolic ion mirror for providing time-of-flight dispersion among product ions of differing mass-to-charge ratios while maintaining near zero flight time dispersion among product ions of the same mass-to-charge ratios having large energy differences; and f) detecting the arrival times of the precursor and product ions.

2. The method according to claim 1, wherein the packet of precursor ions is formed by extracting the precursor ions from an ion source with a focusing voltage pulse.

3. The method according to claim 1, wherein the packet of precursor ions is formed by gating a pulse of mono-energetic precursor ions to an ion buncher.

4. The method according to claim 1, wherein the precursor and product ions are passed through a field free region.

5. A tandem mass spectrometry apparatus comprising:

a) a first mass spectrometer for selecting precursor ions of a predefined mass;

b) means for forming a packet of precursor ions;

c) means for focusing each packet of precursor ions;

d) means for fragmenting the precursor ions to form product ions;

e) an offset parabolic field ion mirror for providing time-of-flight dispersion among product ions of differing mass-to-charge ratios while maintaining near zero flight time dispersion among product ions of the same mass-to-charge ratios having large energy differences; and f) means for detecting the arrival times of the precursor and product ions.

* * * * *